US006886906B2

(12) United States Patent
Maruyama et al.

(10) Patent No.: US 6,886,906 B2
(45) Date of Patent: May 3, 2005

(54) LIQUID EJECTING APPARATUS

(75) Inventors: Norihiro Maruyama, Nagano (JP); Takashi Mano, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/408,653

(22) Filed: Apr. 8, 2003

(65) Prior Publication Data

US 2003/0218653 A1 Nov. 27, 2003

(30) Foreign Application Priority Data

Apr. 9, 2002 (JP) ..... P2002-106037

(51) Int. Cl.[7] ..... B41J 2/165

(52) U.S. Cl. ..... 347/29; 347/30

(58) Field of Search ..... 347/29, 30

(56) References Cited

U.S. PATENT DOCUMENTS 6,422,680 B1 * 7/2002 Hayakawa et al. ..... 347/30

* cited by examiner

*Primary Examiner*—Stephen D. Meier
*Assistant Examiner*—Ly T Tran
(74) *Attorney, Agent, or Firm*—Sughrue Mion, PLLC

(57) ABSTRACT

A liquid ejecting apparatus includes a carriage moving between a liquid ejecting area and a non-liquid ejecting area in a first direction, a liquid ejecting head, having a nozzle formation face from which a liquid droplet is ejected, the liquid ejecting head mounted on the carriage, a slider moving between a non-capping position and a capping position relative to the nozzle formation face in accordance with the movement of the carriage, a capping member provided on the slider, the capping member sealing the nozzle formation face when the slider is positioned on the capping position, a first spring urging the slider, and a guide member provided on the slider, and pushing against a side face of the liquid ejecting head.

13 Claims, 6 Drawing Sheets

LIQUID EJECTING APPARATUS

BACKGROUND OF THE INVENTION

The present invention relates to a liquid ejecting apparatus having a liquid droplet ejection recovery function that employs suction to discharge liquid from a liquid ejecting head.

Since an ink jet recording apparatus produces only a comparatively low printing noise and can form small dots at high density, this recording apparatus has been employed for many types of printing, including color printing.

The ink jet recording apparatus includes a recording head for receiving ink from an ink cartridge and a paper feeder for moving a recording sheet relative to the recording head.

As the recording head is moved in accordance with a print signal, ink droplets are ejected onto the recording sheet, whereon dots are formed for recording. In this case, when recording heads that can ejects colored inks, such as black, yellow, cyan and magenta inks, are mounted on a carriage, full color printing may be performed by changing the colored ink mix ratio.

Since to perform printing using a recording sheet on which ink is ejected as droplets through the nozzle openings of the recording heads, a problem that the adverse effect as to residual ink is occurred on the operation of the ink jet recording apparatus. As the solvent in residual ink evaporates at the nozzle openings, either the viscosity of the ink is increased or the ink solidifies on the nozzle formation face and dust adheres to and clogs the nozzle openings. Thereafter, as this process is continued, air bubbles enter the recording head and a printing failure occurs.

Therefore, in addition to the recording head and the paper feeder, the ink jet recording apparatus includes a capping member for sealing the nozzle formation face of the recording head during a non-printing period, a vacuum pump for removing and expelling ink that accumulates in the capping member, and a wiping member for cleaning the nozzle formation face of the recording head after the ink has been removed by the vacuum pump.

In order to prevent the occurrence of clogging at the nozzle openings and the entry into the recording head of air bubbles, the vacuum pump forcibly removes ink from the recording head and the capping member and expels it, while the wiping member cleans the nozzle formation face of the recording head (wiping).

The forcible ink discharge process performed to prevent the clogging of the recording head, or to remove air bubbles from the recording head, is called a cleaning operation. This cleaning operation is performed when printing is resumed after the recording apparatus has been idle for an extended period of time or whenever a user becomes aware of the occurrence of a printing failure, such as image fogging, and manipulates a cleaning switch.

For the ink jet recording apparatus, the sealing (capping) position of the capping member, relative to the nozzle formation face of the recording head, varies depending on the manufacturing accuracy and the precision with which the individual components are assembled.

In this case, when the manufacturing accuracy for the components is reduced, the capping member (cap) is shifted to a predetermined sealing position, and is brought into contact with the nozzle formation face of the recording head.

To avoid such shifting, guides are provided on both sides of a slider. The guides guide the capping member to a capping position during the capping operation, while the positioning of the capping member is restricted by the guides in the width direction of the recording head. Therefore, the cap is brought into contact with the nozzle formation face at the predetermined sealing position.

However, for the related ink jet recording apparatus, since the guides are provided on both sides of the slider in which the inner-guide size is set by adding a clearance to the size of the recording head in the width direction thereof.

As a result, during the capping operation, the capping member is shifted slightly away from the predetermined sealing position in the width direction of the recording head, and can not seal the nozzle formation face at the predetermined position, which thereby prevents an increase in the capping accuracy.

SUMMARY OF THE INVENTION

It is therefore an object of the present invention to provide a liquid ejecting apparatus wherein a nozzle formation face can be sealed at a predetermined position by a capping member, so that an increase in the capping accuracy is ensured.

In order to achieve the above object, according to the present invention, there is provided a liquid ejecting apparatus comprising:

a carriage, moving between a liquid ejecting area and a non-liquid ejecting area;

a liquid ejecting head, having a nozzle formation face from which a liquid droplet is ejected, the liquid ejecting head mounted on the carriage;

a slider, moving between a non-capping position and a capping position relative to the nozzle formation face in accordance with the movement of the carriage;

a capping member, provided on the slider, the capping member sealing the nozzle formation face when the slider is positioned on the capping position; and a guide member, provided on the slider, and pushing against a side face of the liquid ejecting head in a crossing direction with regard to a moving direction of the slider.

Preferably, the guide member is extended in a direction in which a side face of the slider extends.

Preferably, the liquid ejecting apparatus further comprises a first spring, urging the slider in the crossing direction.

With the configurations, during the capping operation, the guide member, together with the slider, is moved from the non-capping position to the capping position, while the guide member is pressed against one side of the liquid ejecting head in a direction in which the positioning of the capping member is controlled.

Therefore, during the capping operation, since the capping member can be moved without being shifted in the width direction, relative to the liquid ejecting head, the nozzle formation face of the liquid ejecting head can be sealed at a predetermined position by the capping member, and an improvement in the capping accuracy is ensured.

Preferably, the capping member is flexibly provided on the slider through a second spring. The second spring urges the capping member against the guide member so as to restrict a positioning of the capping member.

Here, it is preferably that, the second spring is extended in a direction inclined from the vertical direction.

In the above configuration, wobbling of the slider with respect to the capping member in the width direction of the liquid ejecting head, can be prevented.

Preferably, a center line in a width direction of the slider is parallel to a center line in the width direction of the liquid ejecting head when the liquid ejecting head is pushed by the guide member.

With this configuration, the capping unit can seal the nozzle formation face at a precisely predetermined position, and a superior capping accuracy can be obtained.

Preferably, the width direction of the slider is a direction perpendicular to the moving direction of the slider, and the width direction of the liquid ejecting head is a direction perpendicular to a moving direction of the carriage.

Preferably, the guide member has a guide face which inclines upward, from the inside to the outside of the guide member at an upper end portion of the guide member.

With this configuration, the capping unit can precisely be guided upward, while the vertical guide face of the guide member contacts corners of the liquid ejecting head.

Preferably, the guide member has a horizontal direction guide face along which the liquid ejecting head is guided from the liquid ejecting area to the non-liquid ejecting area.

With this configuration, during the liquid ejecting head moving operation, the liquid ejecting head is guided toward the non-liquid ejecting area while the horizontal guide face of the guide member contacts the corners of the liquid ejecting head.

Preferably, the first spring moves the slider from the capping position to the non-capping position.

Preferably, the slider slides such that the capping member moves parallel to the nozzle formation face.

With this configuration, during the capping operation, the capping member is moved, parallel to the nozzle formation, from the liquid ejecting area to the non-liquid ejecting area.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
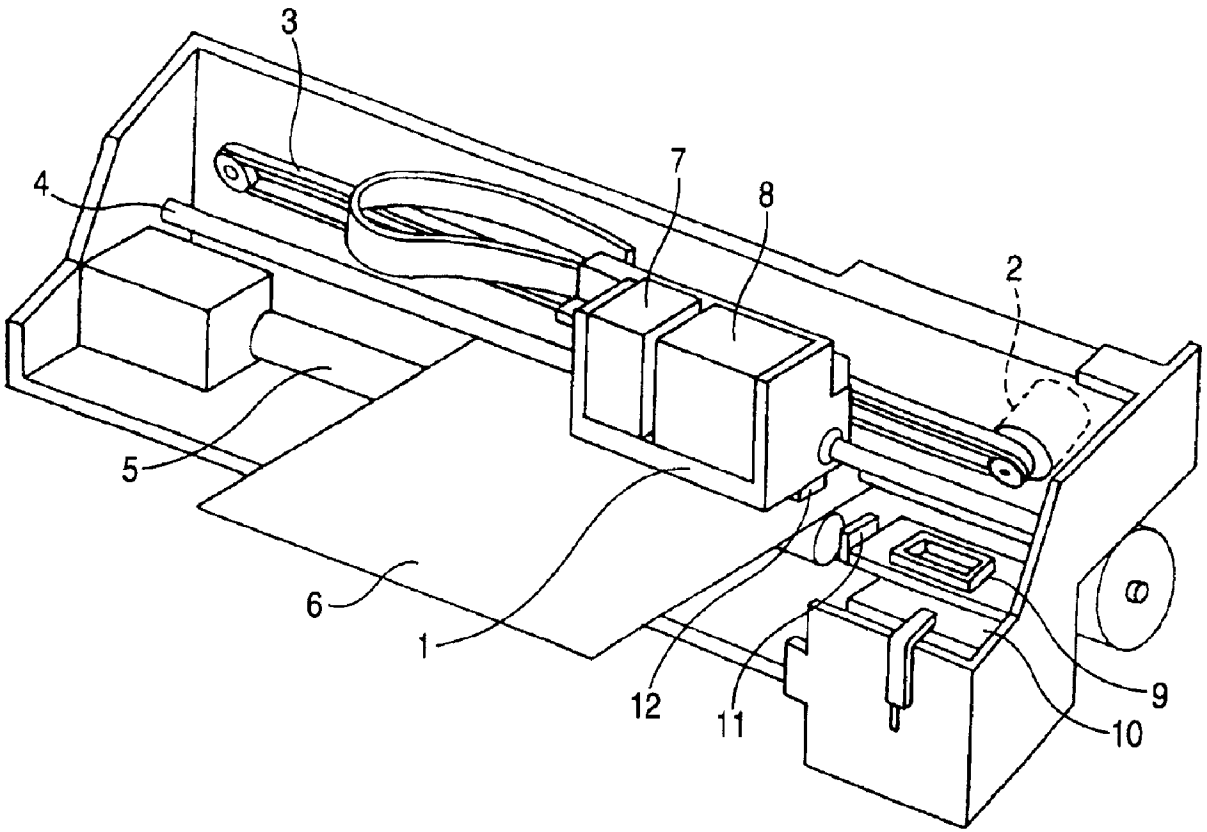
FIG. 1 is a schematic, perspective view of the overall configuration of an ink-jet recording apparatus according to the present invention.

One embodiment of an ink-jet recording apparatus according to the invention will now be described while referring to the drawings. FIG. 1 is a schematic perspective view of the overall configuration of an ink-jet recording apparatus according to the invention.

In FIG. 1, a carriage 1, which is moved by a timing belt 3 driven by a carriage motor 2, is guided along a guide member 4 so that it reciprocates in the axial direction of a platen 5.

A recording head 12 is mounted at the lower face of the carriage 1 (opposite a recording sheet 6), and a black ink cartridge 7 and a color ink cartridge 8, which supply ink to the recording head 12, are detachably supported at the upper face of the carriage 1.

A capping member 9 is arranged in the non-printing area (the home position) of the carriage 1. The capping member 9 rises and seals the nozzle formation face 12*a* of the recording head 12 when the recording head 12 is moved to immediately upward of the capping member 9. As a pump unit for applying a negative pressure within the internal space of the capping member 9, a vacuum pump (a tube pump) 10 is arranged below (to the side) of the capping member.

The capping member 9 serves as a lid for preventing the drying of ink in of the nozzle openings of the recording head during a period wherein the ink-jet recording apparatus is not employed. The capping member 9 also functions as an ink reservoir that is used during a flushing operation for performing a preparatory process for the ejection of ink droplets by transmitting, to the recording head, a drive signal that is not related to printing, and as cleaning unit for applying the negative pressure generated by the tube pump 10 to the recording head 12 to draw in ink.

A wiping member 11 is arranged near the capping member 9, on the side of the printing area, so that it can be moved forward and backward horizontally, perpendicular to the path along which the recording head 12 is moved.

A driving force, produced by a paper feeding motor (which will be described later), used for feeding the recording sheet 6 is also employed to move the wiping member 11 and to operate the tube pump 10 used to attain the vacuum required for the operation of the unit.

Figure 2:
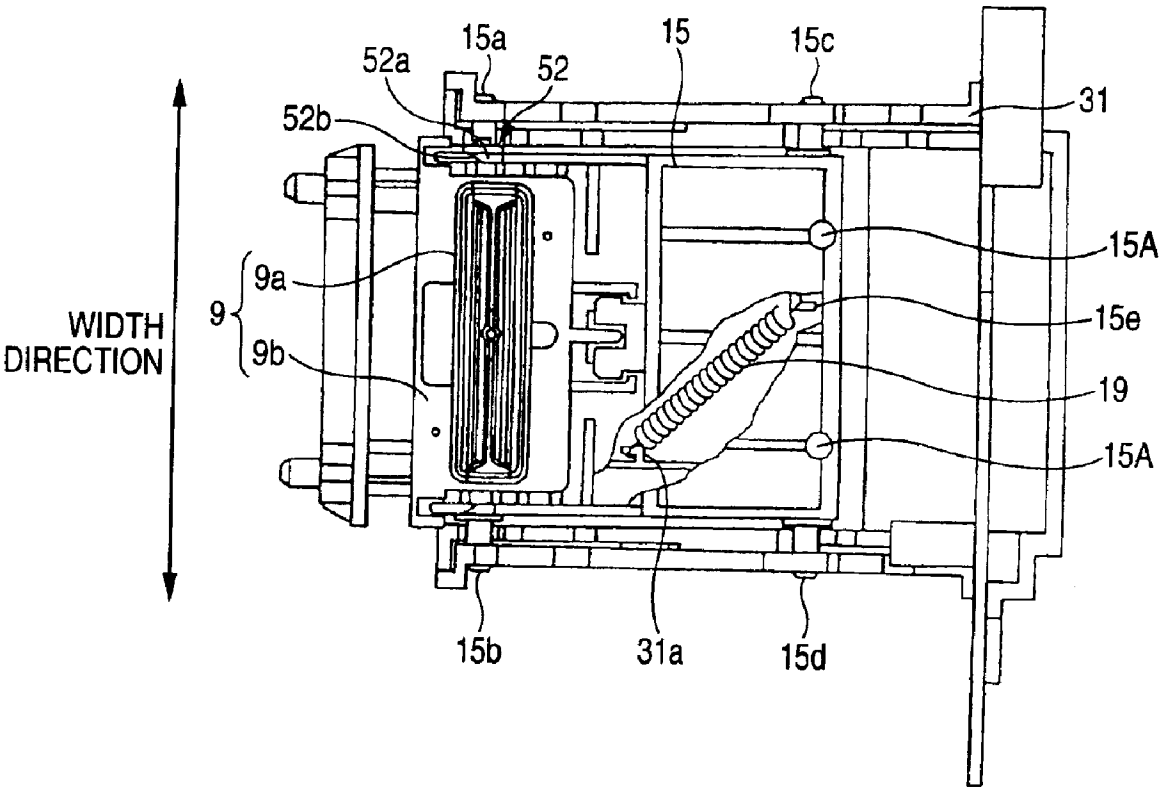
FIG. 2 is a plan view for explaining the essential portion of an ink-jet recording apparatus according to one embodiment of the invention.
Figure 3:
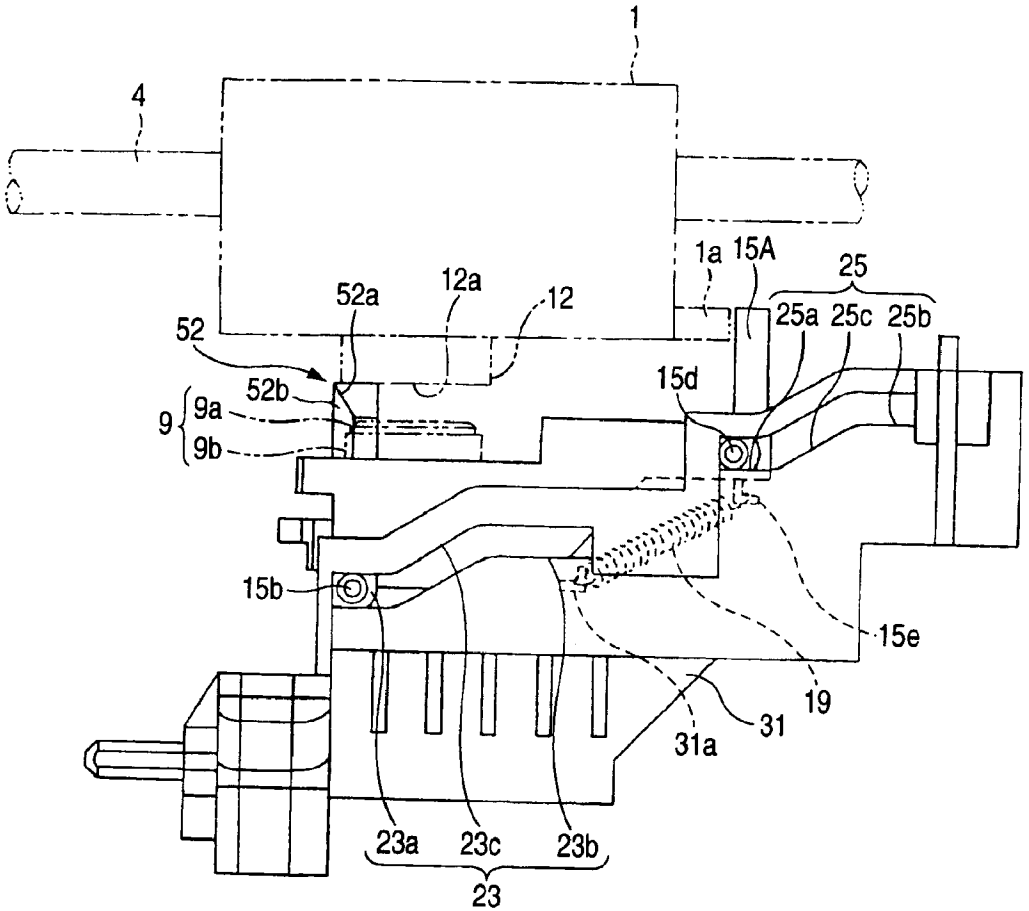
FIG. 3 is a side view of the ink-jet recording apparatus in the non-capping state according to the embodiment of the invention.
Figure 4:
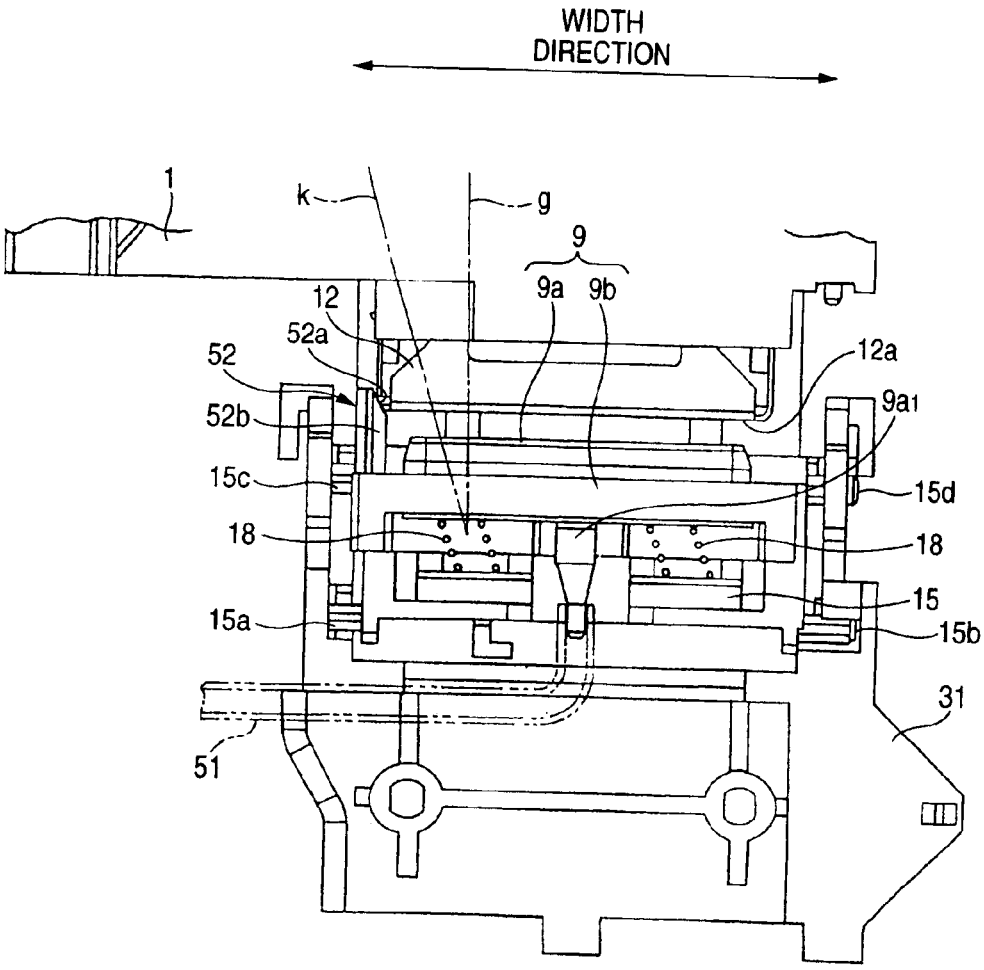
FIG. 4 is a front view of the ink-jet recording apparatus in the non-capping state according to the embodiment of the invention.
Figure 5:
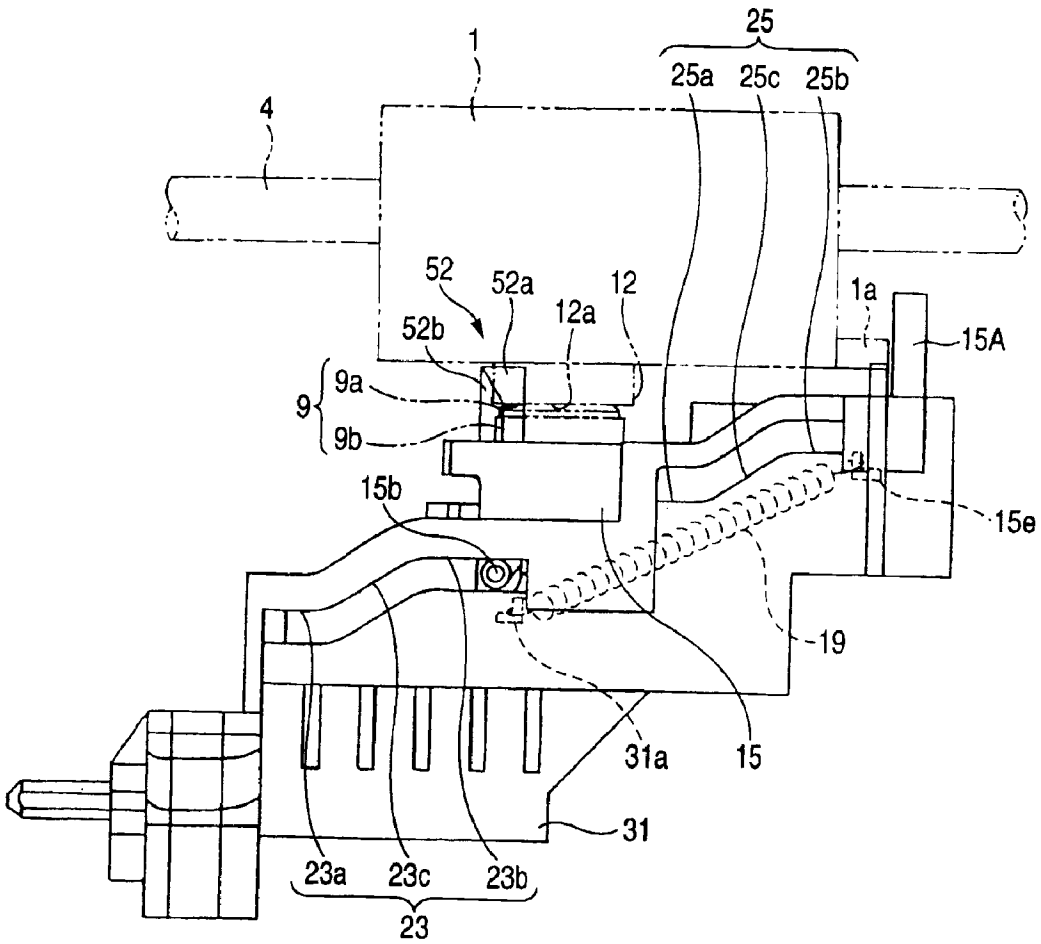
FIG. 5 is a side view of the ink-jet recording apparatus in the capping state according to the embodiment of the invention.
Figure 6:
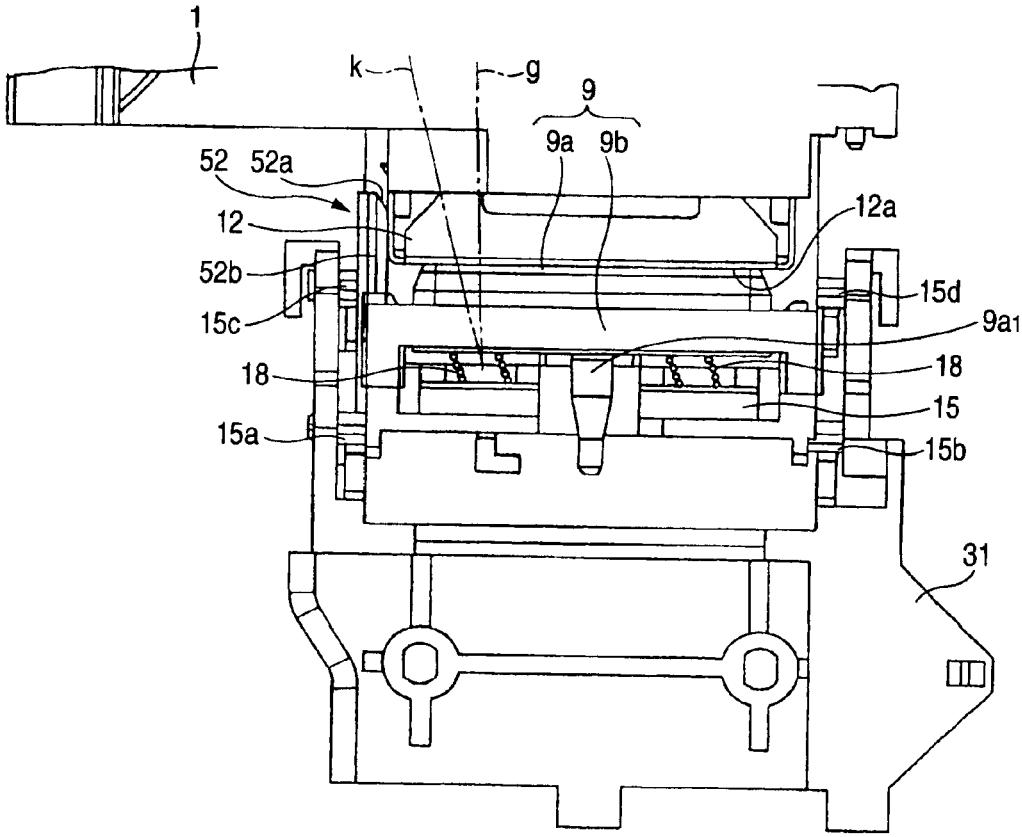
FIG. 6 is a front view of the ink-jet recording apparatus in the capping state according to the embodiment of the invention.

The essential portion of the ink-jet recording apparatus according to the present invention will now be described while referring to FIGS. 2 to 6. FIG. 2 is a plan view for explaining the essential portion of the ink-jet recording apparatus according to the embodiment of the invention. FIGS. 3 and 4 are a side view and a front view of the ink-jet recording apparatus in the non-capping state according to the embodiment of the present invention. FIGS. 5 and 6 are a side view and a front view of the ink-jet recording apparatus in the capping state according to the embodiment of the present invention.

In FIGS. 3 to 6, as is described above, the carriage 1 is guided along the guide member 4 and reciprocates parallel to a sheet guide plate (not shown).

The capping member 9 includes a cap 9*a* for sealing the nozzle formation face 12*a* of the recording head 12, and a cap holder 9*b* for holding the cap 9*a*.

The cap 9*a* includes a downward projecting ink discharge pipe $9a_1$ (shown in FIGS. 4 and 6), which is integrally formed with the cap holder 9*b*, used for a method such as the two-color formation method, and the entire structure is shaped like a box, the sides of which are substantially rectangular planes, that is composed of a flexible material, such as a elastomer. The cap 9*a* is connected to a vacuum pump 10 (shown in FIG. 1) through a flexible tube 51 extending from the ink discharge pipe $9a_1$ to one side of the capping member 9. With this arrangement, upon the reception of a cleaning instruction, negative pressure, produced by the vacuum pump 10, is exerted within the internal space of the cap 9*a* while the nozzle formation face 12*a* of the recording head 12 is sealed, and ink can be forcibly withdrawn from the recording head 12.

The cap holder 9*b*, as well as the cap 9*a*, is shaped like a box that has substantially rectangular planes. The entire structure, however, is constructed of a material harder than that (elastomer) employed for the cap 9*a*. The cap holder 9*b* is flexibly held by compression springs 18 against a slider 15 that serves as a slider elevating mechanism, and is constantly urged (upward) toward the path along which the recording head 12 is moved. The slider 15 moves horizontally (the slider 15 moves parallel to the nozzle formation face 12*a* of the recording head 12) or ascends or descends in accordance with a reciprocating movement of the carriage 1 such that the cap holder 9*b* is moved between the capping position and the non-capping position.

As is shown in FIGS. 4 and 6, the compression springs 18 are provided between the cap holder 9*b* and the slider 15, along axis line k inclined with respect to a perpendicular line g, toward the vacuum pump side (tube lead out side).

Therefore, the cap holder 9*b* is also urged toward one side (tube lead out side) in the width direction of the recording head shown in FIG. 4. The width direction of the recording head is perpendicular to the moving direction of the slider. With this arrangement, the wobbling of the capping member 9 (the cap holder 9*b*) with respect to the slider 15, in the width direction of the recording head can be prevented.

The cap holder 9*b* may be urged by the slider 15 toward the side opposite the tube lead out side to prevent the wobbling of the cap holder 9*b* relative to the slider 15.

The slider 15 is coupled with a fixed frame 31 in the recording apparatus by a tension spring 19, and is urged downward so that the slider 15 is pulled toward the printing area so as to separate form the recording head 12, i.e., so that the capping is urged downwardly from the sealing state in FIGS. 5 and 6 (capping position) to the separating state in FIGS. 3 and 4 (non-capping position).

Therefore, as shown in FIGS. 3 and 4, when the carriage 1 is moved immediately above the capping member 9 toward non-printing area, an engagement member 1*a* provided on the end of the carriage 1 on the non-printing area side, is brought into contact with a upright engagement portion 15*a*, provided on the slider 15. As shown in FIGS. 5 and 6, the slider 15 is further moved, counter to the resilient force applied by the tension spring 19, toward the non-printing area. As a result, the cap 9*a* (the sealing portion) seals the nozzle formation face 12*a* of the recording head 12.

When the carriage 1 is moved toward the printing area, the pressure applied to the engagement portion 15A by engagement member 1*a* of the carriage 1 is released, and the resilient force of the tension spring 19 sets the slider 15 in the state shown in FIGS. 3 and 4. Thus, the cap 9*a* is separated from and releases the nozzle formation face 12*a* of the recording head 12.

The slider 15 is also urged by the tension spring 19 toward the side opposite the tube lead out side in the width direction of the recording head. With this arrangement, during the capping operation, the slider 15 is moved from the non-capping position to the capping position while the slider 15 is urged by the resilient force of the tension spring 19 toward the side opposite the flexible tube 51 lead out side in the width direction of the recording head.

An axial line of the tension spring 19 has upward from the end of the fixed frame 31 on the printing area side, opposite the tube lead out side, to the end of the fixed frame 31 on the non-printing area side, the tube lead out side. One end of the tension spring 19 is held by an engagement portion 31*a* provided on the fixed frame 31, while the other end is held by an engagement portion 15*e*, provided on the slider 15, that is located at a higher position than is the engagement portion 31*a*.

The engagement portion 31*a* is located substantially in the vertical center and at the end of the fixed frame 31 on the printing area side, opposite the tube lead out side (below the fixed frame 31 in FIG. 2). The engagement portion 15*e* is located in the lower portion and at the end of the slider 15 on the non-printing area side, the tube lead out side (substantially in the center in the width direction of the slider 15 in FIG. 2).

Two projections 15*a* and 15*c* are arranged at predetermined horizontal and vertical intervals (forward and backward, and at upper and lower positions) on the tube lead out side of the slider 15 (the left side of the slider 15 in FIGS. 4 and 6). Similarly, two projections 15*b* and 15*d* are arranged at predetermined vertical and horizontal intervals on the opposite side of the slider 15. That is, the projections 15*a* and 15*b* are symmetrically arranged on the printing area side of the slider 15 (the forward side portions), while the projections 15*c* and 15*d* are symmetrically arranged on the non-printing area side (the rearward side portions).

Further, above the projection 15*a*, an upright capping guide 52 is positioned on the tube lead out side of the slider 15. The slider 15 is urged by the tension spring 19 toward on one side of the guide 52 in the width direction of the recording head (the side opposite the tube lead out side of the slider 15). The guide 52 provided on the slider pushes one side portion of the recording head 12 in the urging direction of the slider 15 to align the positioning of both the capping member 9 and the recording head 12. Also, the capping member 9 is urged by the compression springs 18 against the guide 52 such that the positioning of the capping member 9 is restricted.

The guide 52 is so located that, in the state that the guide 52 urges the recording head, the width center line of the slider 15 is parallel to the width center line of the recording head 12. Thus, the capping member 9 (cap 9*a*) can seal the nozzle formation face 12*a* at a precisely predetermined position. A vertical guide face 52*a* of the guide 52 is inclined upward, from the inside to the outside of the guide 52 at an upper end thereof. With this arrangement, the vertical guide face 52*a* is brought into contact with the side corner of the recording head 12 during the capping operation, and the capping member 9 is guided upward (nearer the capping position).

Further, a horizontal guide face 52*b,* provided for the inner wall of the guide 52 on the printing area side, is connected to the vertical guide face 52*a* to guide the recording head from the printing area to the non-printing area. With this arrangement, when the recording head is moved to the non-printing area, the horizontal guide face 52*b* is brought into contact with the corner of the recording head 12 on the non-printing side and guides the recording head 12 to the non-printing area.

Cam holes 23 and 25 for guiding the projections 15*a* to 15*d* are formed in the fixed frame 31. The projections 15*a* to 15*d* are inserted into and movably supported by the cam holes 23 and 25. Low portions 23*a* and 25*a* and high portions 23*a* and 25*b* are formed at the ends of the cam holes 23 and 25, and inclined portions 23*c* and 25*c* are formed between these high and low portions. The low portion 23*a,* the high portion 23*b* and the inclined portion 23*c* on the printing area side are located along the upper internal face of the cam hole 23, while the low portion 25*a,* the high portion 25*b* and the inclined portion 25*c* on the non-printing area side are located along the lower internal face of the cam hole 25.

With this arrangement, when the carriage 1 is moved forward by the carriage motor 2, from the printing area to the non-printing area (the home position), the engagement member 1*a* of the carriage 1 engages the engagement portion 15A of the slider 15. In this case, as the carriage 1 is moved toward the home position, the corner of the recording head on the non-printing area side is brought into contact with the horizontal guide face 52*b* of the guide 52, and the recording head 12 is guided along the horizontal guide face 52*b* toward the non-printing area.

When the carriage 1 is moved further towards the home position, counter to the resilient force exerted by the tension spring 19, the slider 15, together with the capping member 9, is moved from the non-capping position to the capping position. In this case, when the slider 15 reaches the capping position, the projections 15*a* to 15*d* are moved from the low portions 23*a* and 25*a* of the cam holes 23 and 25 along the inclined portions 23*a* and 25*a* to the high positions 23*b* and 25*b*.

As a result, the nozzle formation face 12*a* of the recording head 12 is sealed by the cap 9*a*.

Further, when the slider 15 is moved from the non-capping position to the capping position, the vertical guide face 52*a* of the guide 52 is brought into contact with the side corner of the recording head 12, and the capping member 9 is guided upward (to the capping position) along the vertical guide face 52*b*. At this time, the slider 15 is urged by the tension spring 19 toward on one side of the guide 52 in the width direction of the recording head (the side opposite the tube lead out side of the slider 15). The guide 52 provided on the slider pushes one side portion of the recording head 12 in the urging direction of the slider 15 to align the positioning of both the capping member 9 and the recording head 12. The capping member 9 is urged by the compression springs 18 against the guide 52 such that the positioning of the capping member 9 is restricted.

Therefore, in this embodiment, since during the capping operation the capping member can be moved from the non-capping position to the capping position without being shifted in the width direction of the recording head, the nozzle formation face 12*a* of the recording head 12 can be closed at a predetermined position by the capping member 9, and improved capping accuracy is ensured.

When the sealing of the nozzle formation face 12*a* by the cap 9*a* is accomplished in this manner, the cap 9*a* forms an airtight seal, blocking all communication with the atmosphere and ensuring that no evaporation of ink in the nozzle openings and no clogging of the recording head 12 occur.

When the carriage 1 is returned, by the carriage motor 2, from the non-printing area to the printing area, the engagement member 1*a* of the carriage 1 is separated from the engagement portion 15A of the slider 15. Therefore, due to the resilient force produced by the tension spring 19, the slider 15, together with the capping member 9, is moved from the capping position to the non-capping position. In this case, when the slider 15 is moved to the non-capping position, the projections 15*a* to 15*d* are moved from the high portions 23*b* and 25*b* along the inclined portions 23*c* and 25*c* to the low portions 23*a* and 25*a*. As a result, the recording head 12 is disengaged from the cap 9*a* and separated.

In this embodiment, the capping guide 52, which controls the positioning of the capping member 9, has been provided on the tube lead out side of the slider 15. However, the present invention is not limited to this arrangement, and the guide 52 may be provided on the side of the slider 15 opposite the tube lead out side. In this case, a spring for adjusting the position of the capping member (recovering the slider) is held against the guide and the fixed frame, so that the guide is urged in the direction in which the position of the capping member is controlled.

Furthermore, in this embodiment, on the tube lead out side of the slider 15, the capping member 9 receives the resilient force produced by the compression springs 18, and relative to the slider 15, the wobbling of the capping member 9 in the width direction of the recording head is prevented. However, the present invention is not limited to this arrangement, and the same effects as are obtained in this embodiment can be acquired when an urging force is applied to the capping member on the side opposite the tube lead out side of the slider.

In addition, in this embodiment, an explanation has been given for a recording apparatus wherein the slider 15 is moved horizontally relative to the nozzle formation face 12*a* of the recording head 12. However, the present invention is not thereby limited, and can also be applied for a recording apparatus wherein a slider is moved both rotationally and horizontally.

What is claimed is:

1. A liquid ejecting apparatus comprising:

a carriage, moving between a liquid ejecting area and a non-liquid ejecting area;

a liquid ejecting head, having a nozzle formation face from which a liquid droplet is ejected, and mounted on the carriage;

a slider, moving between a non-capping position and a capping position relative to the nozzle formation face in accordance with the movement of the carriage;

a capping member, provided on the slider, and sealing the nozzle formation face when the slider is positioned on the capping position; and a guide member, provided on the slider, and pushing against a side face of the liquid ejecting head in a crossing direction with regard to a moving direction of the slider.

2. The liquid ejecting apparatus as set forth in claim 1, wherein the guide member is extended in a direction in which a side face of the slider extends.

3. The liquid ejecting apparatus as set forth in claim 1, further comprising a first spring, urging the slider in the crossing direction.

4. The liquid ejecting apparatus as set forth in claim 3, wherein the first spring moves the slider from the capping position to the non-capping position.

5. The liquid ejecting apparatus as set forth in claim 1, wherein the capping member is flexibly provided on the slider through a second spring; and wherein the second spring urges the capping member against the guide member so as to restrict a positioning of the capping member.

6. The liquid ejecting apparatus as set forth in claim 5, wherein the second spring is extended in a direction inclined from the vertical direction.

7. The liquid ejecting apparatus as set forth in claim 1, wherein a center line in a width direction of the slider is parallel to a center line in a width direction of the liquid ejecting head when the liquid ejecting head is pushed by the guide member.

8. The liquid ejecting apparatus as set forth in claim 1, wherein the width direction of the slider is a direction perpendicular to the moving direction of the slider; and wherein the width direction of the liquid ejecting head is a direction perpendicular to a moving direction of the carriage.

9. The liquid ejecting apparatus as set forth in claim 1, wherein the guide member has a guide face which inclines upward, from the inside to the outside of the guide member at an upper end portion of the guide member.

10. The liquid ejecting apparatus as set forth in claim 1, wherein the guide member has a horizontal direction guide face along which the liquid ejecting head is guided from the liquid ejecting area to the non-liquid ejecting area.

11. The liquid ejecting apparatus as set forth in claim 1, wherein the slider slides such that the capping member moves parallel to the nozzle formation face.

12. A liquid ejecting apparatus, comprising:

a carriage, moving between a liquid ejecting area and a non-liquid ejecting area;

a liquid ejecting head, having a nozzle formation face from which a liquid droplet is elected, and mounted on the carriage;

a slider, moving between a non-capping position and a capping position relative to the nozzle formation face in accordance with the movement of the carriage;

a capping member, provided on the slider, and sealing the nozzle formation face when the slider is positioned on the capping position;

a guide member provided on the slider; and an elastic member, pulling the slider to release a sealing of the capping member with regard to the nozzle formation face, and to cause the guide member to push against the liquid ejecting head in a direction cross to a moving direction of the slider.

13. The liquid ejecting apparatus as set forth in claim 12, wherein the elastic member pulls the slider in a direction cross to the moving direction of the slider.

* * * * *